US005643413A

United States Patent [19]

Hoffman

[11] Patent Number: 5,643,413

[45] Date of Patent: Jul. 1, 1997

[54] MULTI-PLY PAPER PRODUCT AND METHOD OF MAKING THE SAME

[75] Inventor: Roger P. Hoffman, Green Bay, Wis.

[73] Assignee: Hoffman Environmental Systems, Inc., Green Bay, Wis.

[21] Appl. No.: 663,556

[22] Filed: Jun. 13, 1996

Related U.S. Application Data

[63] Continuation-in-part of Ser. No. 320,574, Oct. 11, 1994, abandoned.

[51] Int. Cl.[6] ..... D21H 11/14

[52] U.S. Cl. ..... 162/125; 162/127; 162/128; 162/147; 162/189; 162/199; 162/301; 162/DIG. 4

[58] Field of Search ..... 162/123, 125, 162/127, 129, 130, 132, 133, 189, 216, 298, 301, 380, DIG. 4, 128, 147, 199

[56] References Cited

U.S. PATENT DOCUMENTS

| | | | |
|---|---|---|---|
| 3,791,917 | 2/1974 | Bolton | 162/55 |
| 3,833,465 | 9/1974 | Campbell | 162/129 |
| 4,021,295 | 5/1977 | Schmaeng | 162/125 |
| 5,011,741 | 4/1991 | Hoffman | 162/129 |
| 5,055,161 | 10/1991 | Hoffman | 162/189 |

*Primary Examiner*—Peter Chin

*Attorney, Agent, or Firm*—Andrus, Sceales, Starke & Sawall

[57] ABSTRACT

A method of producing a multi-ply paperboard product. A single aqueous recycled pulp stock which contains both heavy contaminants and lightweight contaminants is separated into three fractions, including a first fraction which contains the heavy contaminants, a second middle density fraction that contains the most desirable fibers, and a third low density fraction that contains the lightweight contaminants. The three fractions are discharged from a multi-channel head box onto a forming fabric, with the middle density fraction constituting the base ply in contact with the forming fabric, the low density fraction being the central ply and the high density fraction being the outer ply, thus forming a multiple-ply paperboard product.

11 Claims, 2 Drawing Sheets

MULTI-PLY PAPER PRODUCT AND METHOD OF MAKING THE SAME

This application is a continuation-in-part of application Ser. No. 08/320,574, filed Oct. 11, 1994 abandoned.

BACKGROUND OF THE INVENTION

Many paper and paperboard products are made with a multi-ply construction. Typically, the least contaminated fiber is utilized on the top side of the sheet as the printing surface, and more contaminated fiber is used in the central or outer layers.

The typical multi-ply mill has a very complex system to produce the individual plies that are used in producing paperboard. These systems include individual thick stock pumps and flow controls for the pulp of each ply, separate stuff boxes to maintain the desired pressure to separate basis weight valves, separate cleaner pumps and fan pumps, and often individual headboxes and forming fabrics for each ply. In addition, the system for each ply must be precisely controlled and coordinated with the other ply systems.

In producing the multi-ply product, it has been proposed to deliver the pulp stock from each ply system to a multi-channel headbox. One of the difficulties in this approach is that each channel of the head box is separated from other channels by a very thin membrane, usually composed of stainless steel. As the pressures in each ply system are not equal, the pressure differential in adjacent channels of the headbox can cause damage or deflection to the thin membranes.

Recycled fiber, such as old corrugated containers, newsprint, white office waste, and the like, is playing an ever expanding role in paperboard manufacturing. However, recycled fiber contains heavy contaminants, such as sand, dirt, bark, large fiber bundles called shieves, metal fragments, and the like, as well as lightweight "stickie" contaminants, which are predominantly hot melt adhesives, latexes, pressure sensitive adhesives, waxes and the like.

When using recycled fiber in producing multi-ply paper products, it is important that the heavy contaminants be isolated from the printing surface for the heavy contaminants can mar the printing surface by producing dark colored specks. Similarly, the "stickies" should be maintained out of contact with the clothing and drying surfaces of the paper-making machine, because the "stickies" may adhere to these components.

SUMMARY OF THE INVENTION

The invention is directed to an improved method of producing a multi-ply paper product utilizing a single pulp stock.

Cellulosic pulp stock, preferably composed of recycled pulp which contains heavy contaminants such as sand, dirt, shieves, metal particles and the like, as well as lightweight contaminants such as hot melt adhesives, latexes, wax and the like, is separated into multiple density layers to produce a high density layer containing the heavy contaminants, a low density layer containing the lightweight contaminants or "stickies" and a mid-density layer that is substantially free of contaminants and contains the most desirable fibers.

In one form of the invention, the single recycled pulp stock is separated into the multiple density layers through use of a centrifugal separator. In this method, the pulp, at a very low consistency of about 0.3% to 1.0% solids is pumped into a tangential inlet of the separator and is swirled outwardly in the separator and separated into the three layers. The three layers are discharged tangentially from the separator and pumped to a multi-channel headbox where the three layers are discharged onto a forming fabric, with the middle density layer constituting an inner ply in contact with the forming fabric, the low density layer containing the lightweight contaminants constituting a central ply, and the high density layer containing the heavy contaminants constituting an outer or top ply.

The outer ply containing the heavy contaminants can be contacted with a second forming fabric so that the multi-layer structure is sandwiched between the two forming fabrics, thus increasing the rate of dewatering of the pulp mat to prevent the contaminants from migrating within the low consistency pulp mat.

In a second form of the invention, the pulp stock is divided into three generally equal fractions or streams using multiple cleaners. For example, the single pulp stock can initially be subjected to conventional multi-stage forward cleaning in which a pulp fraction containing the heavier contaminants, including sand, dirt, shieves, and the like, are separated. The pulp after separation of the heavy contaminate pulp fraction, is then subjected to a conventional multi-stage reverse cleaning operation in which a second pulp fraction containing the lighter weight contaminants, including waxes, hot melt adhesives, latexes, and the like, is separated.

After separation of the heavier and light weight pulp fractions, the remaining mid-density pulp fraction is fed to the lower channel of a multi-channel headbox, while the separated higher density fraction is fed to the upper channel of the multi-channel headbox and the separated lower density fraction is fed to the central channel of the multi-channel headbox.

As previously described, the three layers or fractions are fed from the headbox onto a forming fabric in the paper-making machine to form a multi-ply paper product in which the heavy fraction constitutes the outer ply, the light weight fraction comprises the central ply and the mid-density fraction, which contains the most desirable fibers, constitutes the inner ply.

The plies of the paperboard product are all produced from a single pulp, so that only a single pulping system is required. When using a centrifugal separator to produce the separate layers or fractions, the three plies are at the same pressure so that there is no problem of the membranes in the headbox being deformed by a pressure differential between the pulp stocks of the plies.

In the preferred form of the invention, the layer containing the heavy contaminants is used as the outer ply, and thus the heavy contaminants are isolated from the printing surface of the product, which is the bottom surface in this case. The lighter weight "stickies" are preferably used as the middle ply so that they are less likely to contaminate the paper-making machine's clothing and drying surfaces. Moreover, if any light-weight contaminants float within the low consistency pulp mat, they will not show up as flaws on the printing surface. The inner ply contains the most desirable fibers, substantially free of heavy contaminants and "stickies" so that it provides a smooth uniform surface for printing Other objects and advantages will appear during the course of the following description.

DESCRIPTION OF THE DRAWING

The drawings illustrate the best mode presently contemplated of carrying out the invention.

In the drawings.

DESCRIPTION OF THE ILLUSTRATED EMBODIMENT

Figure 1:
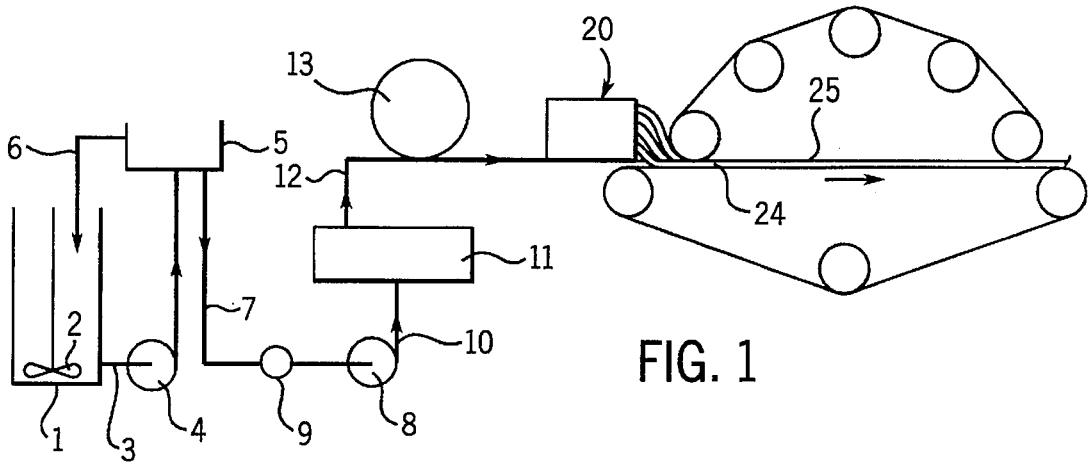
FIG. 1 is a schematic representation showing the method of the invention.
Figure 2:
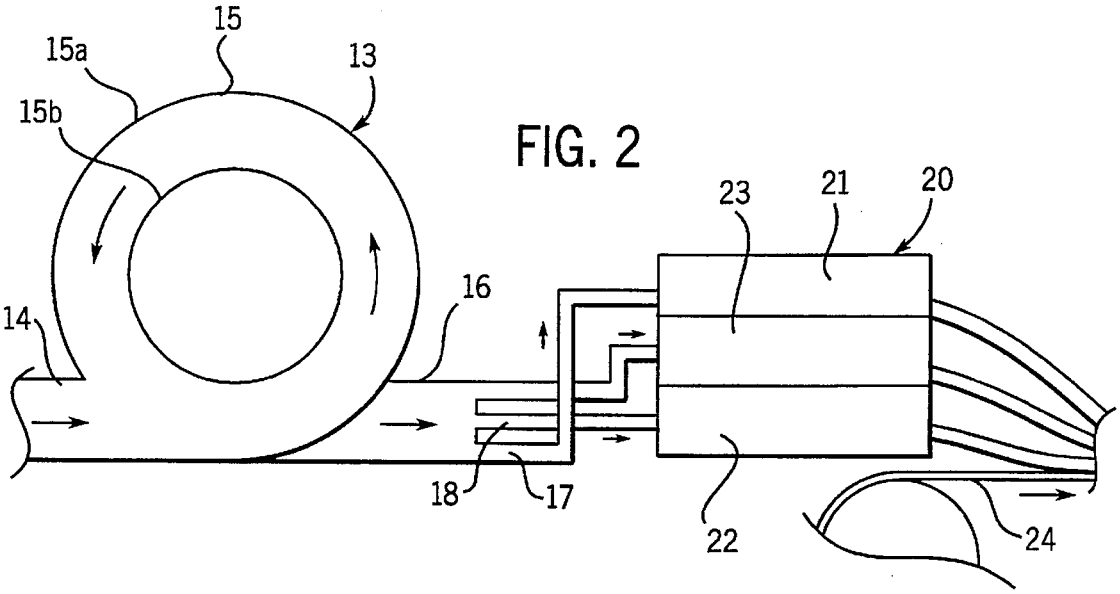
FIG. 2 is a transverse section of a centrifugal separator.

As shown in FIG. 1, cellulosic pulp, preferably recycled pulp from materials such as old corrugated containers, newsprint, office waste and the like, is pulped in a conventional manner and fed to a tank 1 where it is maintained in a moving state by an agitator 2.

The recycled pulp normally contains both heavy contaminants and lightweight contaminants. The heavy contaminants having a specific gravity greater than 1.0 can consist of sand, dirt, bark, shieves, metal fragments and the like, while the lightweight contaminants having a specific gravity less than 1.0 consists of materials such as hot melt adhesives, latexes, pressure sensitive adhesives, wax and the like.

The pulp, at a consistency of about 2% to 6% solids, is withdrawn from tank 1 through line 3 by pump 4, and delivered to a stuff box 5. Overflow from stuff box 5 can be returned through line 6 to tank 1.

The pulp from stuff box 5 is pumped from the stuff box through line 7 by a fan pump 8, and a weight basis valve 9 is mounted in line 7 and controls the weight of the paper or paperboard sheet being formed.

The outlet from the fan pump 8 is connected through line 10 to a screen 11 where larger foreign materials are screened from the pulp. From screen 11 the pulp is conducted through line 12 to a centrifugal type separator 13.

Figure 3:
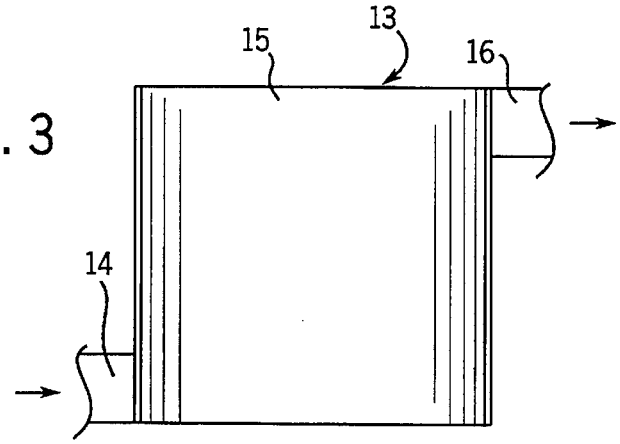
FIG. 3 is a top view of the separator.

Separator 13 includes a tangential inlet 14 which is connected to line 12, and inlet 14 communicates with an annular body 15 composed of an outer wall 15*a* and a concentric inner wall 15*b*. A tangential outlet 16 communicates with the annular passage between walls 15*a* and 15*b* and is located at the lower end of the separator and offset from inlet 14, as best shown in FIG. 3.

The pulp, which is at a consistency of about 0.3% to 1% by weight solids, moves in a swirling path within the annular chamber of separator 13, and the higher density contaminants are thrown outwardly by centrifugal force against the outer wall 15*a* of the separator, while the low density contaminants will be moved radially inward toward the inner wall 15*b*. Thus, the pulp being discharged from the outlet 16, will consist of a lower layer containing the heavy contaminants, a middle layer which is substantially free of contaminants and contains the most desirable fibers, and an upper layer that contains the lightweight contaminants or "stickies". It should be recognized that separator 13 does not function to separate the heavy contaminants and light weight contaminants from pulp, but instead the separator acts to divide the pulp stock into three pulp fractions or streams; one pulp fraction includes the heavy contaminates, a second pulp fraction contains the light weight contaminants, and the third pulp fraction is substantially free of heavy and light weight contaminants.

The three pulp fractions or streams pass into the respective channels or conduits 17, 18 and 19, and are delivered to a multi-channel head box 20 which can be constructed in the manner shown in U.S. Pat. No. 4,021,295. More specifically, lower conduit 17 is connected to an upper chamber 21 of the headbox, the central conduit 18 is connected to lower chamber 22 of the headbox, while upper conduit 19 is connected to the central chamber 23 of the headbox. The pulp in the three chambers 22, 23, and 21 of the headbox is discharged as three layers or plies onto a forming fabric 24. The lower ply, which contains the mid-density pulp that has a minimum of contaminants, is supported on the forming fabric 24 and the lower surface of the ply will constitute the printing surface of the paperboard product. The pulp stock layer containing the lightweight contaminants, constitutes the central ply of the product, while the pulp stock layer containing the heavy contaminants is employed as the top ply of the structure. It is preferred that the multi-ply structure be sandwiched between a pair of forming fabrics, lower fabric 24 and upper fabric 25, for the two forming fabrics will aid in dewatering the multi-ply structure and minimize the migration of contaminants in the low consistency pulp stock.

As the heavy contaminants are in the outer layer, the heavy contaminants are isolated from the printing surface which is the bottom surface, so that the heavy contaminants will not mar the printing surface. As the "stickies" are in the middle of the composite structure, they are less likely to contaminant the clothing and driving surfaces of the papermaking machine. If the lightweight contaminants float in the low consistency pulp mat, they will not show up as flaws on the printing surface. Likewise the heavy contaminants may sink into the sheet a considerable distance before they become visible on the lower printing surface of the paper or paperboard.

As the three layers are all discharged from the centrifugal separator, they will be at the same pressure, so that there is no likelihood of a pressure differential in the headbox channels that could cause deformation of the membrane separating the channels as has occurred in the past when separate pulping systems are used to produce the plies.

The invention also substantially reduces the capital investment for producing a multi-ply paperboard construction, for all the pulp stock for all plies is produced in a single system so that the system only requires a single stock pump, basis weight valve, stuff box, fan pump and the like, as opposed to conventional methods which require a separate system to produce the pulp for each individual ply.

It is contemplated that in situations where it is desired to have printing surfaces on both sides of the multi-ply product, the middle density pulp stock layer that is substantially free of contaminants can be divided and used as both the bottom and top plies.

Similarly, when the pulp does not contain lightweight contaminants or "stickies", the separator can be arranged to separate the pulp into a higher density stream or fraction that contains the heavy contaminants and a lower density stream or fraction that is substantially free of heavy contaminants and contains the most desirable pulp. The lower density fraction can then be applied to the forming fabric as a bottom or base ply and the higher density fraction can be applied to the base ply as a top ply.

Figure 4:
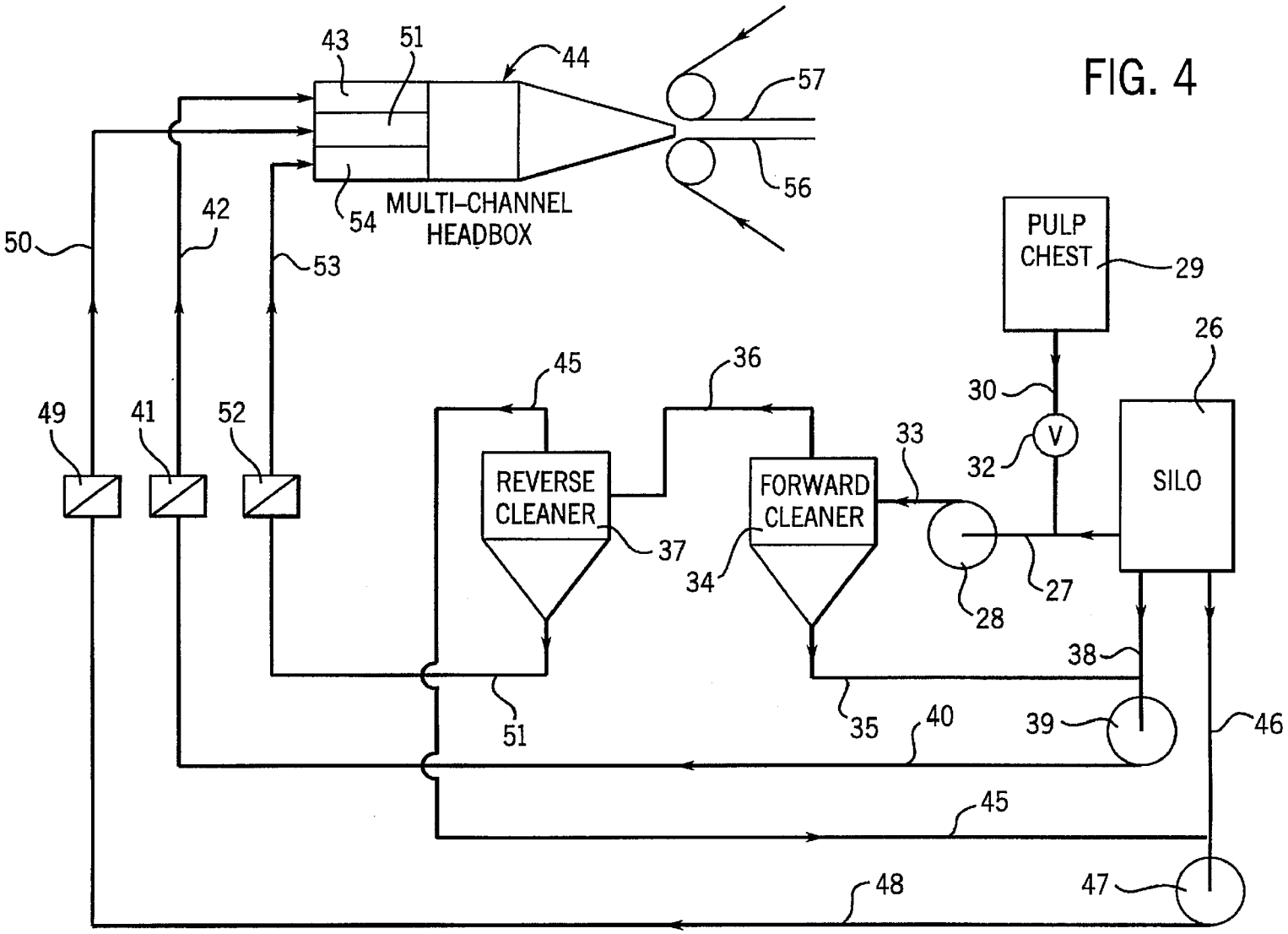
FIG. 4 is a schematic representation of a modified form of the invention.

FIG. 4 represents a modified form of the invention in which conventional centrifugal separators are utilized to divide the pulp stock into three separate pulp fractions or streams. As shown in FIG. 4, silo 26 contains process water and water is drawn from the silo through line 27 by fan pump 28. Pulp chest 29 contains recycled pulp having a consistency in the range of about 2% to 6% by weight and line 30 connects pulp chest 29 and line 27 and serves to deliver the recycled pulp stock to line 27. The flow of the pulp stock in line 27 is metered by a basis weight valve 32 to provide the desired consistency for the pulp as it is drawn into the pump 28.

The pulp stock is discharged by pump 28 through line 33 to forward cleaner 34. Forward cleaner 34 is a conventional, multi-stage, centrifugal-type which acts to separate the heavier contaminants, such as sand, dirt, shieves, and the like. The heavier fraction containing the heavy contaminants is discharged from forward cleaner 34 through line 35 while the remaining pulp is discharged through line 36 to reverse cleaner 37. Line 35, which contains the heavier rejects is joined to line 38, that connects silo 26 and the suction side of fan pump 39. Water from silo 26 is mixed with the heavy contaminant fraction rejected by forward cleaner 34, and the resulting pulp slurry is discharged by pump 39 through line 40 to screen 41 where heavy foreign materials which could interfere with the papermaking operation are removed from the pulp slurry. The pulp slurry then passes through line 42 to the upper channel or compartment 43 of a multiple channel headbox 44. The multiple channel headbox can be constructed in a manner as shown in U.S. Pat. No. 4,021,295.

The reverse cleaner 37 is a conventional multi-stage centrifugal type which serves to remove a lighter weight fraction including waxes, hot melt adhesives, latexes, and the like, from the pulp stock.

The lighter weight pulp fraction is discharged from the reverse cleaner 37 through line 45, which is connected to line 46 that extends between silo 26 and fan pump 47. The pulp slurry containing the lightweight fraction is mixed with process water from silo 26 and the resulting pulp slurry is discharged by pump 47 through line 48 to screen 49. Screen 49 is similar in construction to screen 42. After passing through screen 49 the pulp slurry flows through line 50 to the central compartment 51 of headbox 44.

The remaining pulp, after separation of the light weight fraction in reverse cleaner 37, is discharged from the reverse cleaner through line 51 to screen 52, similar in operation to screen 41, and then flows through line 53 to the lower compartment or channel 54 of the multi-channel headbox 44.

The pulp stock in each of the channels or compartments 43, 51, and 54 of headbox 44 need not be of the same consistency and the pressure in each of the channels can also vary.

As previously described with respect to the first embodiment, the separate pulp stocks in the three channels 43, 51 and 54 are discharged as three layers or plies onto a forming fabric 56. The lower ply which contains the mid-density pulp from channel 54 has a minimum of contaminants, and the lower surface of the ply will constitute the printing surface of the multiple-ply paperboard product. The pulp stock fraction from channel 51 containing the lightweight contaminants constitutes the central ply of the paperboard product, while the pulp stock fraction from channel 43 and containing the heavy contaminants is employed as the top ply of the product. Preferably the multi-ply structure is sandwiched between a pair of forming fabrics, lower forming fabric 56 and upper fabric 57.

The use of the forward and reverse cleaners in the process of the invention differs from the typical use of forward and reverse cleaners in a conventional papermaking operation. In a conventional papermaking operation, the heavy contaminants rejected in the forward cleaners are normally discarded and not used in the papermaking. Similarly, the light weight contaminates rejected in the reverse cleaners are also normally discarded. In contrast, the heavy contaminant fraction separated in the forward cleaners in the process of the invention, and the light weight contaminant fraction separated in the reverse cleaners are not discarded but are used as the top ply and central ply respectively in the multi-ply paperboard structure.

The invention substantially reduces the cost of producing a multiple ply paperboard product by using a single pulp stock that is separated into distinct pulp fractions or streams which are discharged from a multi-channel headbox to provide a product in which the light-weight contaminants are in the central ply, the heavy contaminants are located in the top ply and the fraction substantially free of contaminants is employed as the base ply.

While the drawings have shown the separation of the pulp stock into separate fractions or streams by use of the separator 13, as well as the forward and reverse cleaners 34 and 37, it is also contemplated that the separation can be performed by a gravity operation, in which the pulp stock is flowed slowly through an elongated horizontal channel, causing the heavy contaminates to migrate to the lower portion of the flowing stream and the light weight contaminants to migrate to the upper portion of the stream. The pulp stream can then be divided into three fractions; and upper fraction containing the light weight contaminants, a central fraction being substantially free of contaminants, and a lower fraction containing the heavy contaminants.

I claim:

1. A method of producing a multi-ply paperboard product from recycled cellulosic pulp, comprising the steps of forming an aqueous recycled cellulosic pulp slurry containing heavy contaminants having a specific gravity greater than 1.0 and containing lightweight contaminants having a specific gravity of less than 1.0, dividing the pulp slurry into a first pulp stream containing said heavy contaminants and a second pulp stream containing said lightweight contaminants and a third pulp stream substantially free of said contaminants, applying the third stream to a forming fabric as a base ply, applying the second stream to the outer surface of the base ply as a central ply, applying the first stream to an outer surface of the central ply as an outer ply to thereby produce a multi-ply structure, and removing water from said structure to provide a multi-ply paper product.

2. A method of producing a multi-ply paperboard product from recycled cellulosic pulp, comprising the steps of producing an aqueous recycled cellulosic pulp slurry having a consistency of 0.3% to 1.0% by weight of solids and containing heavy contaminants having a specific gravity greater than 1.0 and containing lightweight contaminants having a specific gravity less than 1.0, subjecting the pulp slurry to centrifugal action to divide the pulp slurry into a first pulp fraction containing said heavy contaminants and a second pulp fraction containing said lightweight contaminants and a third pulp fraction substantially free of said contaminants, applying the third fraction to a forming fabric as a base ply, applying the second fraction to an outer surface of said base ply as a central ply, applying the first fraction to an outer surface of the central ply as an outer ply to thereby produce a multi-ply structure, and removing water from said structure to provide a multi-ply paper product.

3. The method of claim 2, and including the step of engaging the outer surface of the outer ply with a second porous forming fabric.

4. The method of claim 1, and including the step of flowing said first, second and third streams to separate channels of a multi-channel headbox, and discharging said streams from said channels onto said forming fabric.

5. The method of claim 2, and including the step of maintaining the consistency of said pulp slurry when subjected to said centrifugal action at a value of 0.30% to 1.0% by weight of solids.

6. The method of claim 2, wherein the step of subject the pulp slurry to centrifugal action comprises feeding the pulp slurry tangentially into a generally cylindrical compartment to thereby swirl said pulp slurry within said compartment, and discharging said first, second and third fractions tangentially from said compartment.

7. The method of claim 1, wherein said streams are substantially equal in volume.

8. The method of claim 1, wherein the step of dividing the pulp slurry comprises subjecting the pulp slurry to multi-stage forward cleaning followed by multi-stage reverse cleaning.

9. A method of producing a multi-ply paperboard product from recycled cellulosic pulp, comprising the steps of forming an aqueous pulp slurry from recycled cellulosic pulp, said slurry containing heavy contaminants having a specific gravity greater than 1.0 and containing lightweight contaminants having a specific gravity of less than 1.0, subjecting the pulp slurry to multi-stage forward cleaning to separate the pulp slurry into a first portion containing the heavy contaminants and a second portion, subjecting the second portion to multi-stage reverse cleaning to separate the second portion into a third portion containing said lightweight contaminants and a fourth portion, applying the fourth portion to a forming fabric as a base ply, applying the third portion to an outer surface of said base ply to provide a central ply, applying the first portion to an outer surface of the central ply to provide an outer ply and thereby produce a multi-ply structure, and removing water from the multi-ply structure to provide a multi-ply paper product.

10. A multiple layer paper product produced from a single recycled pulp stock, comprising a first inner ply of cellulosic pulp derived from a selected recycled pulp stock, a second outer ply of cellulosic pulp derived from said selected recycled pulp stock, a third central ply of cellulosic pulp derived from said selected recycled pulp stock and disposed between said first and second plies, said second outer ply containing heavy contaminants having a specific gravity greater than 1.0, said third central ply containing lightweight contaminants having a specific gravity of less than 1.0, and said first inner ply being substantially free of said contaminants.

11. The product of claim 10, wherein said second outer ply is substantially free of said light weight contaminants and said third central ply is substantially free of said heavy contaminants.

* * * * *